US006213338B1

(12) United States Patent
Cogdill

(10) Patent No.: US 6,213,338 B1
(45) Date of Patent: Apr. 10, 2001

(54) BRUSH SCRAPER FOR PAINT CANS

(76) Inventor: James E. Cogdill, 2415 Knollwood Rd., Charlotte, NC (US) 28211

( * ) Notice: Subject to any disclaimer, the term of this patent is extended or adjusted under 35 U.S.C. 154(b) by 0 days.

(21) Appl. No.: 09/518,024

(22) Filed: Mar. 3, 2000

Related U.S. Application Data

(60) Provisional application No. 60/122,867, filed on Mar. 5, 1999.

(51) Int. Cl.[7] ..... B65D 25/48

(52) U.S. Cl. ..... 220/700; 220/695; 220/189; 220/570

(58) Field of Search ..... 220/695–702; 222/189, 570

(56) References Cited

U.S. PATENT DOCUMENTS 4,240,568 * 12/1980 Pool ..... 220/701
4,247,013 * 1/1981 O'Hori ..... 220/701
4,911,319 * 3/1990 De Jean ..... 220/700
5,195,662 * 3/1993 Neff ..... 220/701

* cited by examiner

*Primary Examiner*—Joseph M. Moy
(74) *Attorney, Agent, or Firm*—Mineo & Whittaker; Malcom E. Whittaker

(57) ABSTRACT

A brush scraper comprising a circular cap having an inner and an outer lip, said inner and outer lips being downwardly disposed to cooperatively and frictionally engage a lid rim of a paint can and an arcuate flange which is substantially upwardly perpendicular to said circular cap and a scraper element comprising a pair of flanges extending substantially horizontally and integral with said arcuate flange and a single flange extending substantially horizontally from said pair of flanges, said scraper element extending between and being supported by said arcuate flange and a pourer which is integral with said arcuate flange, said pourer positioned on said circular cap substantially distal from said scraper element.

9 Claims, 2 Drawing Sheets

Fig.2
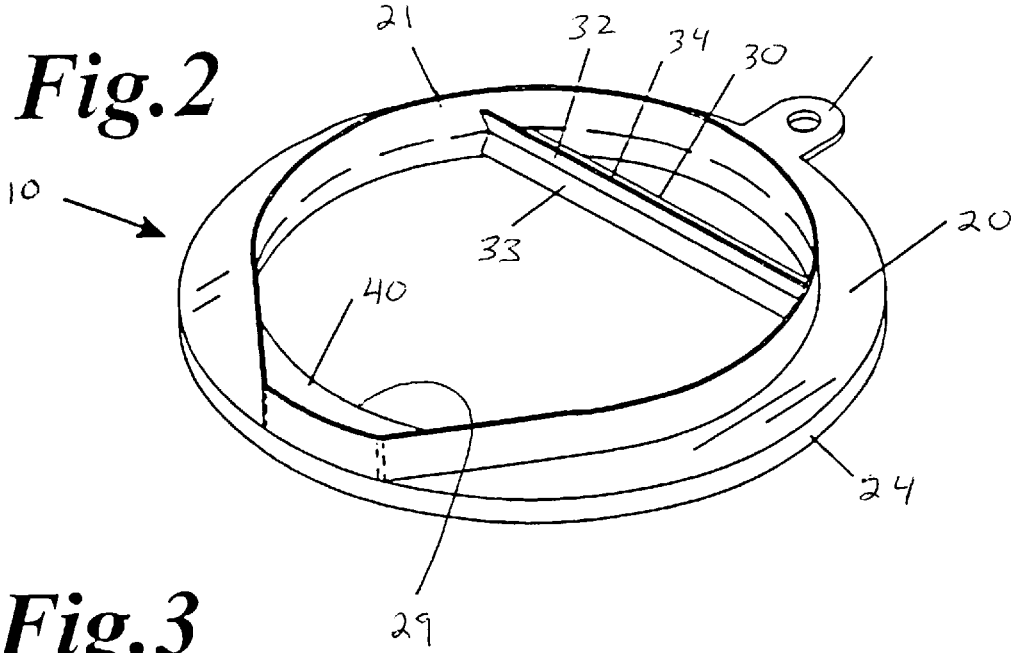
Fig.3
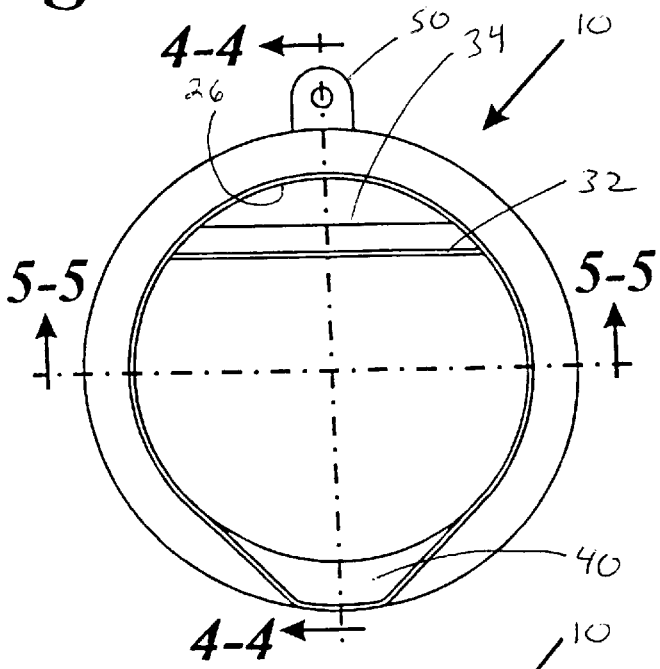
Fig.4
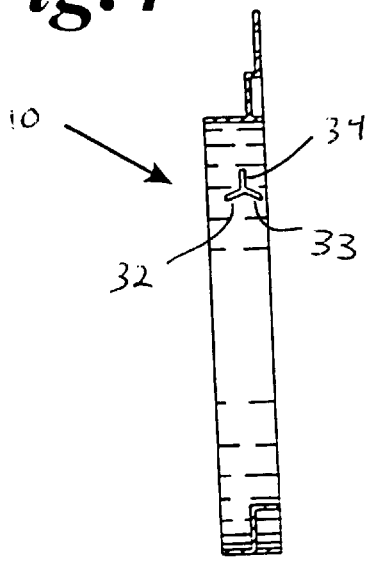
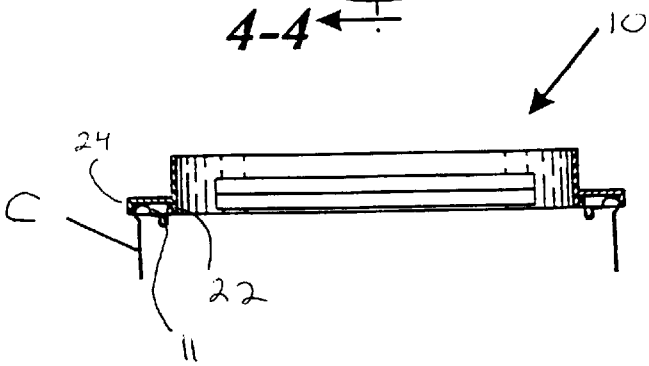
Fig.5

BRUSH SCRAPER FOR PAINT CANS

This appln claims benefit of Ser. No. 60,122,867 filed Mar. 5, 1999.

This invention relates to scraping excess paint from paint brushes and more specifically to a brush scraping apparatus including embodiments for attachment to an open paint can and alternative embodiment that may be formed integrally with a paint can when manufactured or later installed by the user after the can has been opened for use.

Using a brush and a can of paint to paint any surface is a routine practice. The painter typically applies paint to the brush by dipping the bristles of the brush in the paint can. Usually, there is excess paint on the brush after it is taken out of the paint can. Painters usually scrape the excess paint from the brush before applying the paint to the surface that he or she is painting. In many cases, painters will pour about half of the can of paint into a second can. The allows the painter to scrape the paint from the brush on the rim of either can to remove excess paint from the brush.

The inside upper edge or rim of the paint can is normally the most convenient place to scrape excess paint from the brush and it is the rim of the can that most painters normally use to scrape off excess paint before applying the paint brush to the surface that he or she is painting. Scraping the paint brush against the rim removes most of the excess paint from the brush, but is creates a mess and the inevitable dripping of paint outside the paint can. The mess clogs the lid rim of the paint can and prevents easy resealing of the paint can.

BRIEF DESCRIPTION OF THE DRAWINGS

FIG. 2 is a perspective view of the present invention.

FIG. 3 is a top view of the present invention.

FIG. 4 is a sectional view of the present cut along the line 4—4 seen in FIG. 3.

FIG. 5 is a sectional view of the present invention cut along the line 5—5 seen in FIG. 3.

DETAILED DESCRIPTION OF THE INVENTION

Figure 1:
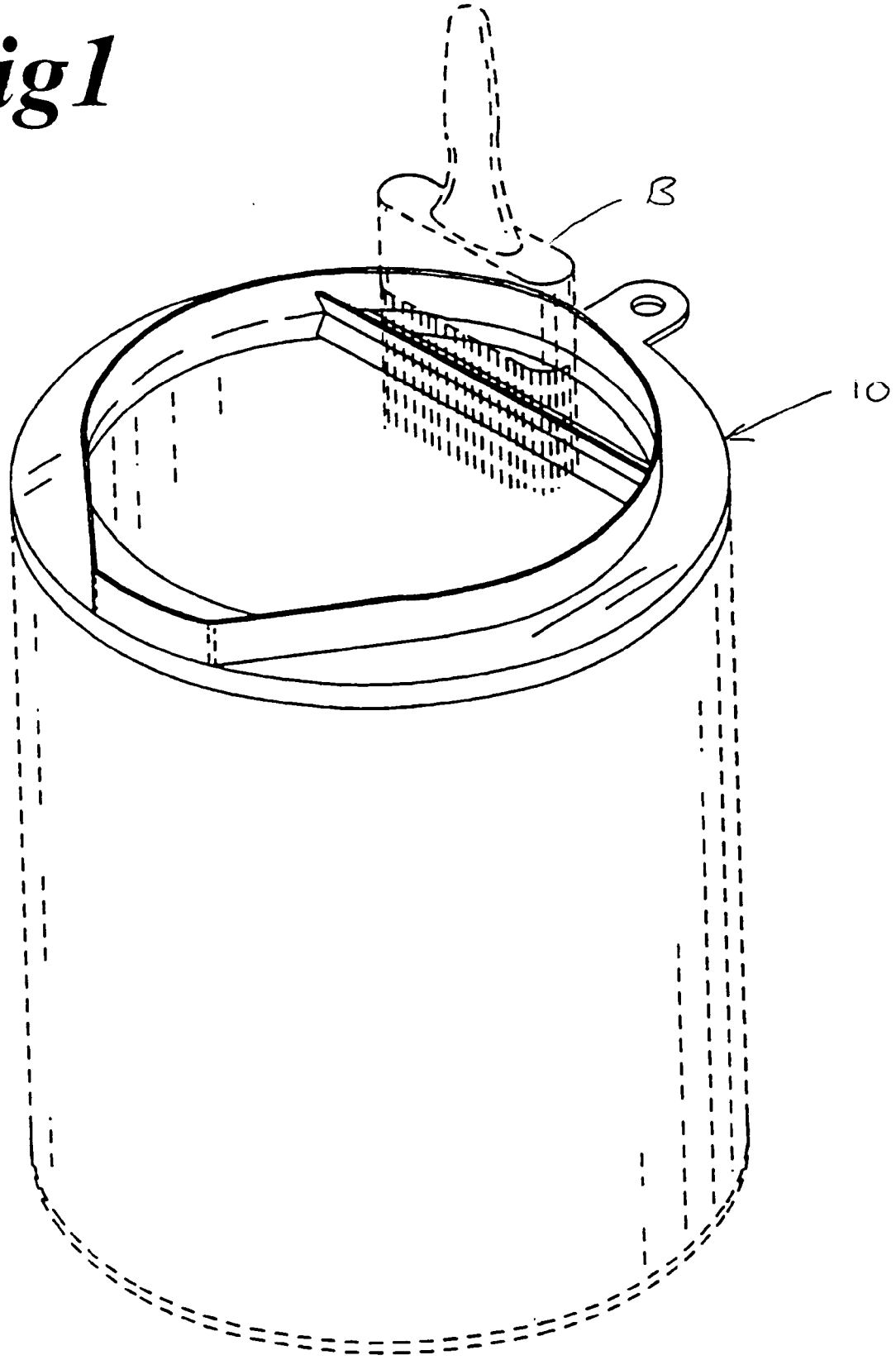
FIG. 1 is a perspective view of the present invention in use on a typical paint can.

The embodiments of the brush scraper are illustrated can be used in conjunction with a typical one gallon paint can or can also be used in conjunction with a typical paint pot.

In the embodiment seen in FIGS. 1–5, the brush scraper 10 includes a circular cap 20 having an inner lip 22 and outer lip 24. Inner lip 22 and outer lip 24 are disposed downwardly. Inner lip 22 and outer lip 24 are disposed so that they cooperatively frictionally fasten brush scraper 10 to a paint can C or paint pot. The frictional attachment of inner lip 22 and outer lip 24 to circular channel 11 of Paint Can C is best seen in FIG. 5. Circular cap 20 and inner and outer lips 22 and 24, cooperatively seal lid rim 11 of paint can C so that paint cannot collect in lid rim 11. An arcuate flange 21 extends upwardly from circular cap 20 and supports scraper element 30 vertically above the top of paint can C. The spacing of scraper element 30 eliminates the need for pouring paint from a full paint can to provide room to scrape excess paint from brush B.

Scraper element 30 comprises a pair of flanges 32 and 33 extending from arcuate flange 21 and a horizontally disposed flange 34 extending substantially horizontally between flanges 32 and 33. There is a space between flange 34 and proximate side 26 of paint can C. As discussed above, the spacing of scraper element 30 eliminates the need for pouring paint from a full paint can to provide room to scrape excess paint from brush B.

Pourer 40 is arcuate in shape and extends upwardly from circular cap 20 and is located at the distal side 29 of paint can C. Pourer 40, best seen in FIGS. 2 and 3, is shaped to channel paint out of paint can C and to minimize any spillage. For ease of manufacturing, pourer 40 is typically forms an integral part of arcuate flange 21.

Tab 50 is used to allow a painter to remove brush scraper 10 from a paint can C or a paint pot or because of the hole disposed therethrough, to hand the brush scraper 10 from a hanger, hook or nail when not in use.

It is well know in the industry that paint scrapers are readily made from plastic or similar materials. It is also well known in the industry that paint cans or pots may come in one gallon, one pint, one quart or five gallon containers. In addition, paint is typically sold in one pint, one quart, one gallon or five gallon cans. Typically, a paint can or paint pot is cylindrically shaped.

I claim:

1. A brush scraper comprising:

a circular cap having an inner and an outer lip, said inner and outer lips being downwardly disposed to cooperatively and frictionally engage a lid rim of a paint can;

an arcuate flange which is substantially upwardly perpendicular to said circular cap;

a scraper element comprising a pair of flanges extending substantially horizontally and integral with said arcuate flange and a single flange extending substantially horizontally from said pair of flanges, said scraper element extending between and being supported by said arcuate flange;

a pourer which is integral with said arcuate flange, said pourer positioned on said circular cap substantially distal from said scraper element.

2. A brush scraper as claimed in claim 1 wherein said brush scraper is formed from plastic or a similarly easily formed or poured material.

3. A brush scraper as claimed in claim 1 wherein said circular cap further includes a tab, said tab radially extending from said circular cap.

4. A brush scraper as claimed in claim 3 wherein said tab has a hole therethrough, said hole being of sufficient diameter to allow said brush scraper to be readily hung from a hanger.

5. A brush scraper as claimed in claim 1 wherein said paint can is a typical cylindrical paint can containing one U.S. gallon of paint.

6. A brush scraper as claimed in claim 1 wherein said paint can is a typical cylindrical paint can containing one U.S. pint of paint.

7. A brush scraper as claimed in claim 1 wherein said paint can is a typical cylindrical paint can containing one U.S. quart of paint.

8. A brush scraper as claimed in claim 1 wherein said paint can is a typical cylindrical paint can containing five U.S. gallons of paint.

9. A brush scraper as claimed in claim 1 wherein said paint can is a typical cylindrical paint pot.

* * * * *